US007383804B2

(12) United States Patent
Wolber et al.

(10) Patent No.: US 7,383,804 B2
(45) Date of Patent: Jun. 10, 2008

(54) PROCEDURE TO RECOGNIZE A DEPRESSURIZED FUEL SYSTEM

(75) Inventors: Jens Wolber, Gerlingen (DE); Karsten Hinn, Famington Hills (DE); Timm Hollmann, Ludwigsburg (DE); Matthias Walz, Vaihingen/Enz (DE); Marcel Matischok, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 28 days.

(21) Appl. No.: 11/595,239

(22) Filed: Nov. 9, 2006

(65) Prior Publication Data

US 2007/0101973 A1 May 10, 2007

(30) Foreign Application Priority Data

Nov. 9, 2005 (DE) ..... 10 2005 053 406

(51) Int. Cl.
*F02D 41/06* (2006.01)

(52) U.S. Cl. ..... 123/179.16; 123/458; 123/494; 123/179.17

(58) Field of Classification Search ..... 123/179.16, 123/179.17, 457, 458, 467, 494
See application file for complete search history.

(56) References Cited

U.S. PATENT DOCUMENTS 5,074,272 A * 12/1991 Bostick et al. ..... 123/514
5,327,872 A * 7/1994 Morikawa ..... 123/516
5,572,964 A * 11/1996 Cogneville et al. .... 123/179.17
6,076,507 A * 6/2000 Blizard et al. ..... 123/467
6,267,104 B1 * 7/2001 Monnier ..... 123/516
6,408,825 B1 * 6/2002 Enoki et al. ..... 123/467
6,615,807 B2 * 9/2003 Rembold et al. ..... 123/516
6,895,916 B2 * 5/2005 Kaneko et al. ..... 123/179.4
6,959,697 B2 * 11/2005 Kojima ..... 123/516
7,066,152 B2 * 6/2006 Stroia et al. ..... 123/467
7,082,928 B2 * 8/2006 Fritsch et al. ..... 123/478
7,225,796 B2 * 6/2007 Reddy et al. ..... 123/516
2004/0250795 A1 * 12/2004 Stroia et al. ..... 123/447

* cited by examiner

*Primary Examiner*—Thomas Moulis
(74) *Attorney, Agent, or Firm*—Merchant & Gould P.C.

(57) ABSTRACT

A procedure to recognize a depressurized fuel system of a motor vehicle with an internal combustion engine that includes a parameter characterizing the fuel system temperature is acquired when turning off the internal combustion engine; a parameter characterizing the fuel system temperature is acquired in the immediately subsequent driving cycle when starting the internal combustion engine; and from the difference between the shut-down temperature and the starting temperature, the pressure in the fuel system is inferred.

7 Claims, 3 Drawing Sheets

PROCEDURE TO RECOGNIZE A DEPRESSURIZED FUEL SYSTEM

FIELD OF THE INVENTION

The invention concerns a procedure to recognize a depressurized fuel system of a vehicle with an internal combustion engine.

BACKGROUND

In present day high pressure fuel systems for gasoline engines, system pressures up to 200 bar are necessary. The fuel high pressure is closed-loop controlled as a function of the operating conditions of the internal combustion engine. When the internal combustion engine is turned off, the pressure existing in the high pressure fuel system is not actively reduced, but is initially maintained in the fuel system. After turning the engine off, a so-called post heating phase results, in which the temperature of the engine and thereby also the temperature of the fuel system and of the fuel rises up to a maximum amount. By means of a heat expansion of the fuel, the pressure rises in the fuel system. After that, the internal combustion engine, the fuel system and the fuel cool down. If this phase is sufficiently long, the entire vehicle cools down to the ambient air temperature. As a result of the cooling down, the fuel contracts, whereby the fuel pressure sinks in the fuel system.

Fuel pressure diagnosis procedures are now, for example, known from the field of the invention, during which the pressure sensor initially is checked for its electrical operating capability and consequently a test takes place to see if the sensor can acquire the desired range (so-called "Range Check"). The test for electrical operating capability results, for example, by acquisition of the fuel pressure sensor voltage. In so doing, it can be ascertained, if a drop in load, a short circuit of the battery voltage or a short circuit of the battery ground exists. In the so-called "Range Check", a test is made, if the indicated fuel pressure value lies within a plausible specified value range.

In addition procedures exist to test the fuel pressure sensor with the aid of the lambda-closed-loop control of the engine and to determine its operational capability. If the fuel pressure in the rail does not correspond to the fuel pressure indicated by the sensor, the amount of fuel injected is no longer correct and the lambda-closed-loop control has to conduct a correction of the amount of fuel injected. Using the lambda-controller intervention, it can not only be recognized, if the fuel pressure sensor is in good working order but rather an offset of the fuel pressure sensor can be determined, and in this way the sensor value can be adjusted. It is now, however, problematic that with such a diagnosis for an offset of the fuel pressure sensor to be reliably recognized, because, for example, error/tolerances in the air system also lead to an intervention of the lambda-closed-loop control.

The task of the invention is to impart a procedure to recognize a depressurized fuel system of a motor vehicle. Additionally a procedure shall be created, with which the operational capability of the fuel pressure sensor and especially its possibly ensuing offsets can be determined.

ADVANTAGES OF THE INVENTION

This task is solved by a procedure to recognize a depressurized fuel system of a motor vehicle with the characteristics of claim 1.

Advantageous embodiments and configurations of the procedure are the subject matter of the sub-claims referring back to claim 1.

The basic idea of the invention is to make a statement about the pressure in the fuel system from the conditions existing when the internal combustion engine is turned off and from the edge conditions when starting the engine at a subsequent driving cycle, i.e. at the next starting of the engine. Especially it should be recognized, if after a shut-down phase of the engine, the fuel pressure has sunken down to the ambient pressure or down to another specified value, for example, a value, which is defined by an electrical fuel pump, which is already located in the pre-running phase. At this point the invention proposes to acquire initially a parameter characterizing the fuel system temperature when the engine is being turned off, subsequently known as the shut-down temperature. During a subsequent driving cycle, a parameter characterizing the fuel system temperature when starting the engine is acquired (subsequently known as starting temperature). From the difference of the shut-down temperature and the starting temperature, a conclusion can be drawn about the pressure in the fuel system. In this manner it can be recognized if a pressure drop in the fuel system has occurred without the implementation of a pressure measurement with a high degree of precision.

Preferably in this process a depressurized fuel system is inferred, if the difference between the shut-down temperature and the starting temperature exceeds an initial threshold, which can be specified. Depressurized means in this instance either that the pressure in the fuel system essentially corresponds to the ambient pressure or that it essentially corresponds to one in the lower pressure range of the fuel system, i.e. in the range of the pressure prevailing from the tank up to the high pressure pump. Hence, the fuel system is preferred which is evaluated as depressurized, when the prevailing pressure in the fuel system is smaller than a pressure threshold, which can be specified.

According to an advantageous embodiment, this procedure can also be used for the purpose of determining the operational capability of a pressure sensor disposed in the fuel system and if need be its available offset.

For this purpose inference is made about the operational capability of the pressure sensor by means of a comparison of the pressure obtained from the difference between the shut-down temperature and the starting temperature with a pressure value, which by way of a pressure sensor disposed in the fuel system is measured during a subsequent driving cycle when starting the internal combustion engine.

In a preferred embodiment of the procedure, a positive offset error is inferred, if the difference between the shut-down temperature and the starting temperature exceeds the specifiable first threshold and the pressure value exceeds a second specifiable threshold. If in this case, for example, the difference between the shut-down temperature and the starting temperature exceeds the first specified threshold (threshold 1), and if therefore it can be assumed that the fuel system is depressurized and simultaneously the pressure sensor value exceeds the second specified threshold, a positive offset error must be assumed, which if need be can be adjusted. In this case, the pressure sensor indicates a value, which cannot be physically possible, so that a positive offset must exist. A positive offset means in the context of this application a displacement of the sensor characteristic curve or a change of the slope of the characteristic curve in an upward direction, i.e. toward larger values. Negative offset means correspondingly a displacement of the sensor characteristic curve or a change of the characteristic curve slope toward smaller values.

In another form of embodiment, which allows the acquisition of a negative offset error, such a negative offset error is inferred, if the pressure value before starting the internal combustion engine during an immediately subsequent driving cycle within a specifiable time span does not exceed a specifiable pressure threshold. On the other hand, an inference cannot be made about a negative offset, if the pressure value during starting of the engine is greater than zero and the difference between the shut-down temperature and the starting temperature during starting of the engine exceeds the first threshold (threshold 1). In this case it must be assumed that the fuel system is depressurized and the pressure sensor is in good working order, as it is indicating a positive value. The acquisition of the pressure value before starting the engine results as the starter motor is turning over. In this phase the pressure sensor value for the fuel system is acquired during a certain specifiable time. By operating the starter motor and the high pressure pump, which is connected to the starter motor's operation, with a closed magnetic control valve, high fuel pressure is built up in the rail. If the internal combustion engine starts and the pressure sensor value has indicated a constant value 0 MPa during a certain time period before starting the engine, an offset error is set at a certain time after completion of starting the engine. Due to the fact that the engine starts, a corresponding minimal rail pressure must in fact have been present, and consequently it can be ruled out that the electrical fuel pump is defective or that the fuel tank is empty For the time, within which the pressure value is acquired and for the threshold of the offset test of the fuel pressure sensor, the build-up of the rail pressure on account of air or steam in the fuel system must be taken into account, which is possible in an inherently known manner.

For the acquisition of the parameter, which characterizes the fuel system temperature, one or several of the following parameters can be measured: intake air temperature, oil temperature, coolant temperature, ambient air temperature, fuel temperature of the internal combustion engine.

BRIEF DESCRIPTION OF THE DRAWINGS

Additional advantages and characteristics of the invention are the subject matter of the following description as well of the technically drawn depiction of the examples of embodiment.

In the drawing, the following are shown.

DETAILED DESCRIPTION OF THE DRAWINGS

Figure 1:
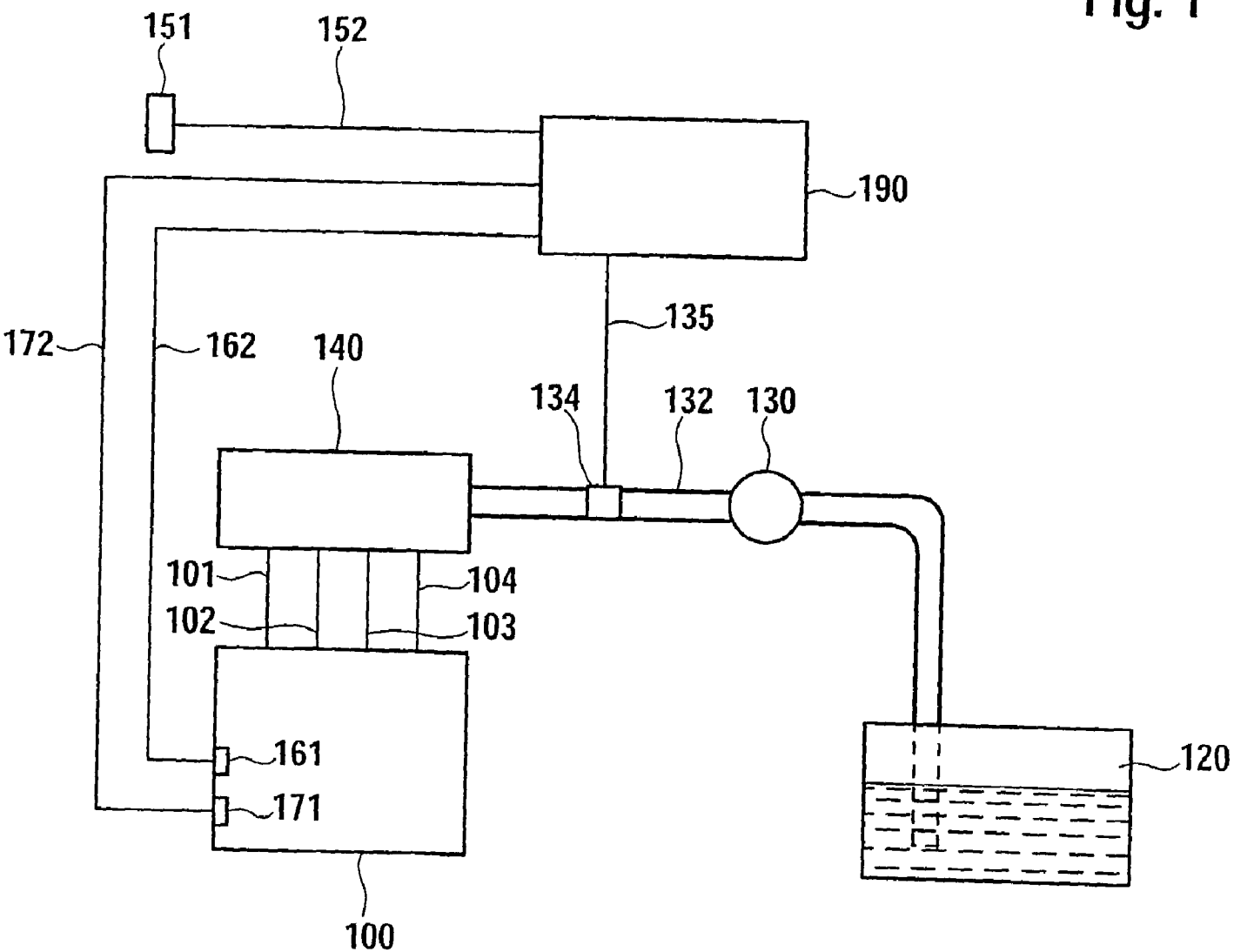
FIG. 1 schematically the internal combustion engine of a vehicle, in which the procedure according to the invention is deployed.

A high pressure fuel system for an internal combustion engine 100 is schematically depicted in FIG. 1. This high pressure fuel system comprises a fuel tank 120, from which a pump 130 delivers fuel. The pump 130 is a high pressure fuel pump, which delivers fuel under high pressure into a rail 140. The pressure of the fuel can in the process amount to 200 bar. The fuel is injected under such a high pressure into combustion chambers of an internal combustion engine. In the example depicted a total of four routes of injection 101, 102, 103 and 104 are schematically depicted. In a high pressure fuel line 132 leading from the pump 130 to the rail 140, a fuel pressure sensor is disposed, whose output signal is supplied to a control unit 190 by way of an electrical lead. Moreover, an intake air temperature, which is acquired by means of a corresponding sensor 151, can also be supplied to the control unit by way of a lead 152.

Additionally provision can be made for a sensor 161 to acquire the oil temperature of the internal combustion engine and for a sensor 171 to acquire the coolant temperature of the internal combustion engine 100, whose output signals are provided to the control unit 190 by way of corresponding electrical leads 162 and 172.

In order now to recognize a depressurized fuel system, a parameter, which characterizes the fuel system temperature, is acquired when the internal combustion engine is turned off. This parameter can, for example, be the intake air temperature, the oil temperature or the coolant temperature or also several of these parameters. This temperature, which is subsequently named shut-down temperature, is stored in the control unit 190.

In an immediately subsequent driving cycle, a parameter again characterizing the temperature of the fuel system when restarting the internal combustion engine 100 is ascertained, and this temperature subsequently denoted as the starting temperature is stored in the control unit 190. In the control unit the difference between the shut-down temperature and the starting temperature is formed, and from this an inference is made about the pressure in the fuel system, which is subsequently described in more detail. Especially an inference is made, if the fuel system is depressurized.

Inference is then always made about a depressurized fuel system, i.e. about a fuel system, whose pressure corresponds to the ambient pressure or to the pressure, which prevails in the low pressure area of the fuel system, i.e. in the area from the fuel tank 120 up to the pump 130, if the difference between the shut-down temperature and the starting temperature exceed a specifiable first threshold. If the difference between the shut-down temperature and the starting temperature in fact exceeds the threshold, it can be assumed that the pressure in the fuel system has sunken to the ambient pressure. A depressurized fuel system arises in fact, if a sufficient fuel contraction is guaranteed during the shut-down phase. During shut-down of the internal combustion engine, the rail pressure cannot be actively taken down. Therefore, one is dependent upon a sure procedure, which allows a reduction of pressure to be ascertained by fuel contraction.

The procedure is especially supposed to take into account ambient effects. During the shut-down phase, the engine temperature and fuel pressure sink on account of fuel contraction as a result of lower ambient air temperature, for example, at night. If, for example, the ambient air temperature rises, for example, due to solar radiation during the day, the temperature of the motor vehicle then also rises and the fuel pressure can again rise as a result of the heat expansion. In this connection, it must also be taken into account that a so-called post heating phase occurs, at which the temperature of the internal combustion engine and thereby also the temperature of the fuel system and the fuel rise to a maximum value. Subsequently the engine as well as the fuel system and the fuel cool down again. If this cool-down phase is sufficiently long, the entire motor vehicle cools down to the ambient air temperature.

Figure 2:
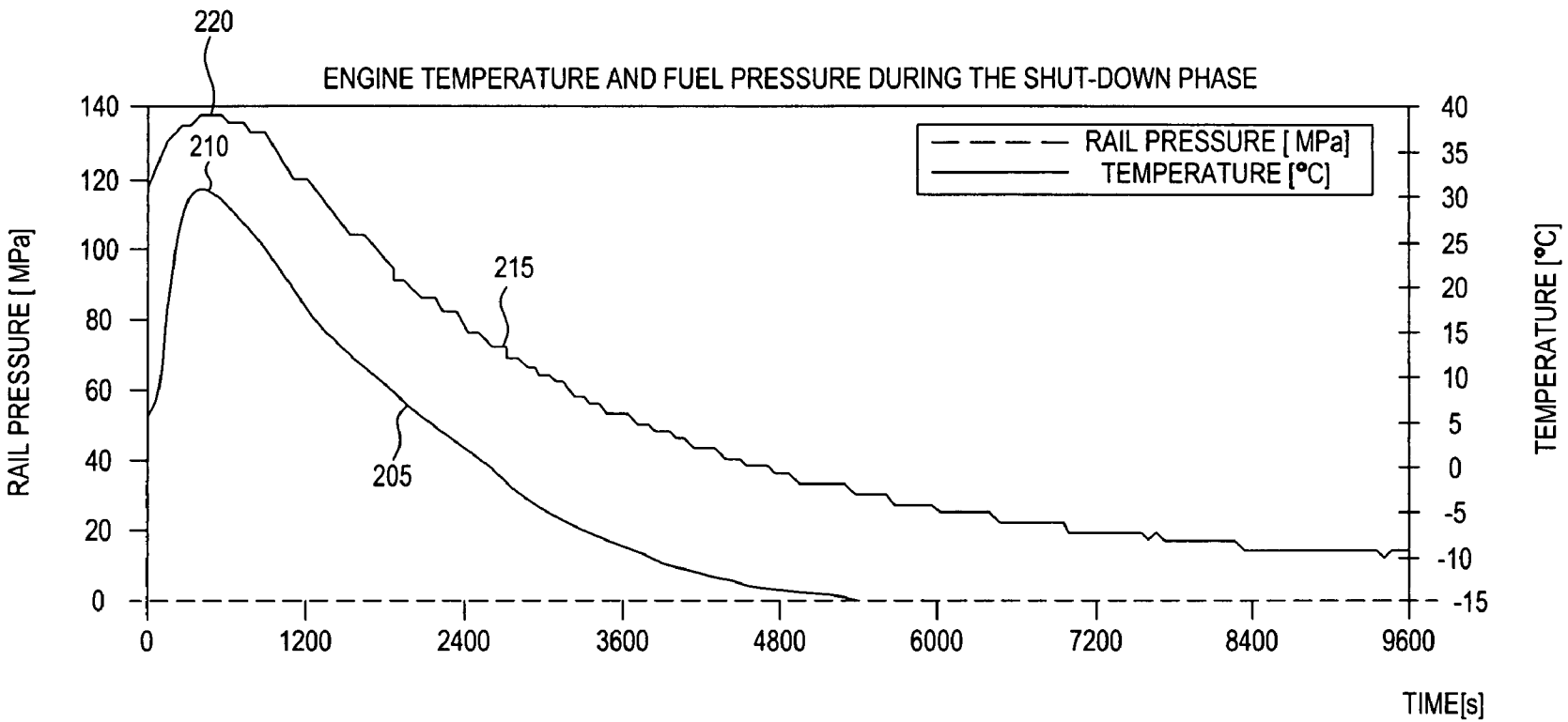
FIG. 2 schematically the rail pressure as well as the temperature over the time period of the shut-down phase of the internal combustion engine.

As a result of the cooling of the fuel, it contracts and the fuel pressure in the fuel system consequently sinks to an ambient pressure. This process is schematically depicted in FIG. 2, where the fuel pressure, in this case the rail pressure 205, and the temperature 215 of the fuel system are depicted in the time duration of a shut-down phase. The rail pressure 205 as well as the temperature 215 in the fuel system have in each case the previously mentioned maximum value 210, respectively 220.

The fuel pressure 205 as well as the fuel system temperature 215 approach with cumulative time asymptotically a characteristic value in each case.

The procedure can especially be deployed, in order to acquire positive and negative offset errors of the pressure sensor 134 disposed in the fuel system. Such offsets can be compensated for in the control unit 190.

Figure 3:
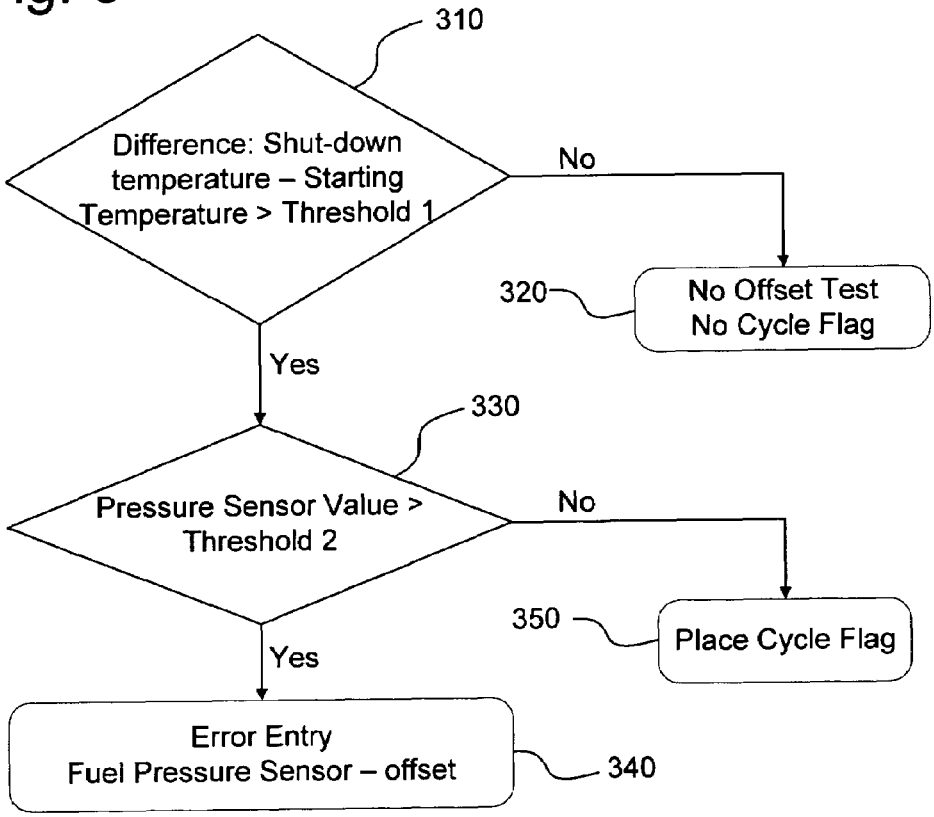
FIG. 3 a flow diagram of a variation of the procedure according to the invention and FIG. 4 a flow diagram of an additional variation of the procedure according to the invention.

Subsequently the determination of a positive offset, i.e. an upward deviation of the value measured with the pressure sensor 134 from the real pressure value is detailed using FIG. 3.

Initially a test is made in a step 310 to see if the difference from the shut-down temperature and the starting temperature exceeds a specifiable threshold. If this is not the case, an offset test of the pressure sensor 134 can not occur and no cycle flag can be placed in the control unit 190 (Step 320), as no pressure reduction has occurred in the fuel system. The placing of the cycle flag occurs in the control unit as proof for the implementation of an offset test. If on the other hand, the edge condition is fulfilled, when it can thereby be assumed that the pressure in the fuel system corresponds to the ambient pressure, a test is made in step 330 to see if a pressure sensor value acquired by means of a pressure sensor 134 exceeds a second threshold. If this condition is fulfilled, i.e. if the pressure sensor 134 indicates a greater value than is physically possible, an error entry of the fuel pressure sensor offset is then registered in the control unit 190 (Step 340). It is understood in this connection that tolerances of the components of the fuel system have to be taken into account. The previously described test can, for example, occur after a forerun of the electric fuel pump, when a selected primary pressure has consequently been reached. If on the other hand, the pressure sensor value is not greater than the threshold 2, the cycle flag is placed. In this case, it must be assumed that the pressure sensor is functioning in good working order and no offset is present, as the value acquired from the sensor lies in a physically plausible range.

Figure 4:
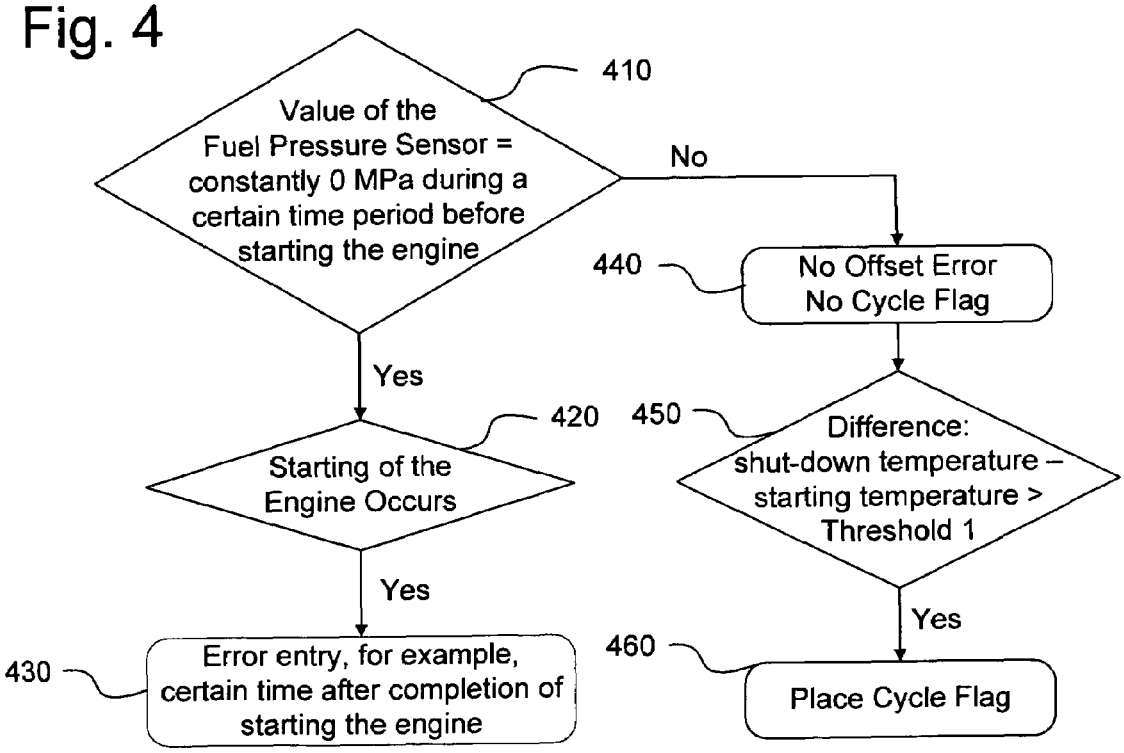

A variation of the procedure, which allows the determination of a negative offset error, is described subsequently in connection with FIG. 4. Initially a test is made in step 410 to see if the value acquired by the fuel pressure sensor is constantly 0 MPa during a certain time before starting the engine, i.e. before starting the internal combustion engine. If this is the case, a test is made in step 420 to see if a starting of the engine has occurred. If this is not the case, no statement can be made about the function of the fuel pressure sensor 134. If the condition is, however, fulfilled, an error entry occurs in the control unit 190 (Step 430) after a specifiable time after completion of starting the engine.

If on the other hand it is determined in Step 410 that the pressure value in the fuel system acquired by the fuel pressure sensor 134 is not zero, a conclusion is made thereupon that no negative offset error exists (Step 440).

If the engine 100 starts and the fuel pressure sensor 134 acquires the constant value 0 MPa during a specific time period before starting the engine, an offset error must therefore exist. If on the other hand, the value acquired by the fuel pressure sensor 134 deviates from zero, a minimal rail pressure must exist and it can already be assumed here, that the electric fuel pump is defective and the fuel tank is empty. For the determination of the times before starting the engine, during which the pressure value is acquired, and for the determination of the threshold of the fuel pressure sensor, the rail pressure buildup must be taken into account in an inherently known manner for the case that air or steam exists in the fuel system. No cycle flag can, however, be placed, with which an entry can occur in the control unit 190 that an offset test has been conducted, because in this procedural step, it has not yet been established, if the pressure in the fuel system has sunken to the ambient pressure. Therefore, a test is made in step 450, if the difference from the shut-down temperature and the starting temperature exceeds the specified threshold 1. If this is the case, the so-called cycle flag is placed, which indicates that an offset test has taken place.

The previously described procedure was described on the basis of the difference between the shut-down temperature and the starting temperature. The procedure is, however, not limited to the determination of this temperature difference. Instead of the temperature difference, a shut-down time can also, for example, be acquired and tested to see if the shut-down time exceeds a specified threshold. In so doing, it is assumed that upon exceeding this threshold, the pressure in the fuel system has sunken to the ambient pressure.

The invention claimed is:

1. A method of recognizing a depressurized fuel system of a motor vehicle with an internal combustion engine, the method comprising:

acquiring a shut-down temperature of the fuel system when turning off the internal combustion engine;

acquiring a start-up temperature of the fuel system temperature immediately subsequent a driving cycle when starting the internal combustion engine;

inferring a pressure in the fuel system from the difference between the shut-down temperature and the start-up temperature.

2. A method according to claim 1, wherein inferring includes inferring a specified value if the difference between the shut-down temperature and the starting temperature exceeds a specifiable first threshold.

3. A method according to claim 1 further comprising evaluating the fuel system as depressurized if the pressure in the fuel system is smaller than a specifiable pressure threshold.

4. A method according to claim 1, further comprising determining the functional capability of the pressure sensor by comparing the pressure with a measured pressure value by a pressure sensor disposed in the fuel system during starting of the internal combustion engine in the immediately subsequent driving cycle.

5. A method according to claim 4, further comprising inferring a positive offset error of the pressure sensor if a difference between the shut-down temperature and the starting temperature exceeds a first threshold and if the pressure exceeds a specified second threshold.

6. A method according to claim 4, further comprising a negative offset error if the pressure in an immediately subsequent driving cycle during starting of the internal combustion engine does not exceed a specifiable pressure threshold with a specifiable time span.

7. A method according to claim 1, wherein acquiring a shut-down temperature or a start-up temperature includes measuring at least one of the following parameters:

intake air temperature oil temperature coolant temperature ambient air temperature fuel temperature.

* * * * *

UNITED STATES PATENT AND TRADEMARK OFFICE

CERTIFICATE OF CORRECTION

PATENT NO. : 7,383,804 B2
APPLICATION NO. : 11/595239
DATED : June 10, 2008
INVENTOR(S) : Jens Wolber et al.

It is certified that error appears in the above-identified patent and that said Letters Patent is hereby corrected as shown below:

On the title page item (75), line 2, "Famington Hills" should read -- Farmington Hills --

Signed and Sealed this

Twenty-first Day of October, 2008

JON W. DUDAS
*Director of the United States Patent and Trademark Office*